US012569044B2

(12) United States Patent
Gruber

(10) Patent No.: US 12,569,044 B2
(45) Date of Patent: Mar. 10, 2026

(54) DEVICE FOR THE APPLICATION OF HAIR DYE

(71) Applicant: IFT Handels- und Entwicklungsgesellschaft mbH, Hargelsberg (AT)

(72) Inventor: Ronald Gruber, Steyr (AT)

(73) Assignee: IFT Handels- und Entwicklungsgesellschaft mbH, Hargelsberg (AT)

( * ) Notice: Subject to any disclaimer, the term of this patent is extended or adjusted under 35 U.S.C. 154(b) by 485 days.

(21) Appl. No.: 18/265,846

(22) PCT Filed: Dec. 7, 2021

(86) PCT No.: PCT/EP2021/084543
§ 371 (c)(1),
(2) Date: Jun. 7, 2023

(87) PCT Pub. No.: WO2022/135903
PCT Pub. Date: Jun. 30, 2022

(65) Prior Publication Data

US 2024/0023688 A1 Jan. 25, 2024

(30) Foreign Application Priority Data

Dec. 22, 2020 (AT) ..... A 51124/2020

(51) Int. Cl.
*A45D 19/02* (2006.01)

(52) U.S. Cl.
CPC ..... *A45D 19/024* (2021.01); *A45D 19/026* (2021.01)

(58) Field of Classification Search
CPC .. A45D 19/024; A45D 19/026; A45D 19/012; A45D 19/02; A45D 19/016;
(Continued)

(56) References Cited

U.S. PATENT DOCUMENTS 1,607,674 A 11/1926 Shazo
3,638,665 A * 2/1972 Staffas, Sr. ..... A45D 24/36 132/129

(Continued)

FOREIGN PATENT DOCUMENTS

DE 30 39 829 8/1981
FR 2 939 779 6/2010

(Continued)

OTHER PUBLICATIONS

Austria Grant Decision issued in counterpart Austria Patent Application No. A 51124/2020 (Apr. 3, 2023).

(Continued)

*Primary Examiner* — Tatiana L Nobrega
*Assistant Examiner* — Sarah Woodhouse
(74) *Attorney, Agent, or Firm* — GREENBLUM & BERNSTEIN, P.L.C.

(57) ABSTRACT

Device for applying free-flowing hair dye to regions of hair includes a housing having a handle with a housing interior for receiving the free-flowing hair dye. The housing has a cover with a row of hair receptacles arranged next to one another in a longitudinal direction of the housing and extend in a channel-like manner in a transverse direction of the housing, which each open towards the housing exterior for the insertion of regions of hair. In a first set of hair receptacles, the hair receptacles are connected to the housing interior via dispensing openings for hair dye, and hair-dye-free hair receptacles of a second set are arranged between the hair receptacles of the first set. A supply element is arranged in the housing interior for supplying hair dye from the housing interior to the dispensing openings of the hair receptacles of the first set.

8 Claims, 5 Drawing Sheets

Figure 1:
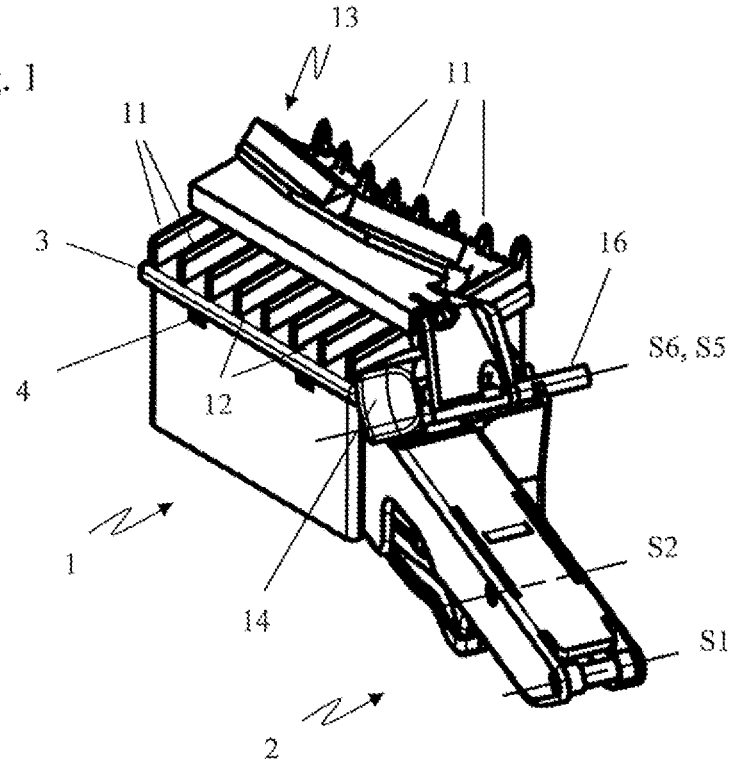

(58) Field of Classification Search
CPC ..... A45D 19/028; A45D 19/022; A45D 19/0075; A45D 24/22; A45D 24/26; A45D 24/28; A45D 24/24; A45D 24/36; A45D 24/04; A45D 24/06; A45D 24/10; A46B 11/0037
USPC ..... 132/270, 112, 113, 114, 115, 116; 222/352, 386
See application file for complete search history.

(56) References Cited

U.S. PATENT DOCUMENTS 4,516,591 A * 5/1985 Hierholzer ..... A45D 24/24 401/265
4,691,720 A * 9/1987 Schmitz ..... A45D 19/026 132/112
4,702,398 A * 10/1987 Seager ..... B65D 83/766 222/326
4,898,304 A * 2/1990 Bacon, Jr. ..... B67D 7/0227 222/386
5,059,050 A * 10/1991 Guglielmo ..... A45D 19/02 401/207
5,060,679 A * 10/1991 Christopher ..... A45D 24/28 401/176
5,333,627 A * 8/1994 Mehringer ..... A45D 40/262 401/179
5,365,952 A * 11/1994 Noble ..... A45D 24/36 132/129
5,725,130 A * 3/1998 Kluge ..... B05B 11/1032 222/212
8,671,954 B2 3/2014 Conn
2010/0012141 A1* 1/2010 Middlebrook ..... A45D 24/22 132/202
2012/0228332 A1* 9/2012 Huang ..... A45D 24/26 222/190
2014/0261519 A1 9/2014 Kodama
2016/0066673 A1* 3/2016 Pham ..... A46B 9/023 401/291

FOREIGN PATENT DOCUMENTS

WO 88/09632 12/1988
WO 2007/098181 8/2007

OTHER PUBLICATIONS

Int'l Search Report (Form PCT/ISA/210) conducted in Int'l Appln. No. PCT/EP2021/084543 (Mar. 30, 2022).
Int'l Written Opinion (Form PCT/ISA/237) conducted in Int'l Appln. No. PCT/EP2021/084543 (Mar. 30, 2022).

* cited by examiner

DEVICE FOR THE APPLICATION OF HAIR DYE

The invention relates to a device for applying free-flowing hair dyes to regions of hair, according to the preamble of claim 1.

The invention is particularly suitable for the application of hair dyes obtained by mixing an oxidizing agent such as hydrogen peroxide with at least one dye. Such compositions are prepared immediately before application and are flowable but very viscous to gel-like. The hair dyes, for example for dyeing, toning or bleaching hair, are sometimes applied only to individual regions of hair, also known as passes or strands. There are various techniques for this. For example, a passé is usually picked up with one hand and with the other hand, using a comb handle that is guided across the passé, the passé is divided into individual strands of as uniform a width as possible above and below the comb handle. The strands above the comb handle are then placed on a comb board and the hair dye is applied with a brush. The comb board is moved along the strands until the strands have been dyed with the hair dye over their entire length. Known techniques of this type have the disadvantage that they are very laborious and time-consuming, and therefore expensive for the consumer. In addition, it takes practice and experience to divide a passé into individual strands of uniform width and color them, while working cleanly and quickly, so that a satisfactory result can be achieved for the consumer. In the daily practice of hair salons, these requirements cannot always be met.

It is therefore the object of the invention to provide a device for applying free-flowing hair dye to regions of hair, which facilitates the shaping of strands and the application of hair dye while maintaining consistent quality, as well as enabling faster and cleaner work.

These objects are achieved by the features of claim 1.

Claim 1 relates to a device for applying free-flowing hair dye to regions of hair, in which it is proposed in accordance with the invention that a housing having a handle and a housing interior for receiving the free-flowing hair dye is provided, and the housing is provided with a cover which has a row of hair receptacles which are arranged next to one another in a longitudinal direction of the housing and extend in the form of channels in a transverse direction of the housing and are each open with respect to the exterior of the housing for the insertion of the regions of hair, wherein in the case of a first set of the hair receptacles, the hair receptacles are connected in each case to the interior of the housing via dispensing openings for dispensing hair dye, and hair receptacles of a second set, which are free of hair dye, are arranged between the hair receptacles of the first set, and a supply element for supplying hair dye from the interior of the housing to the dispensing openings of the hair receptacles of the first set is arranged in the interior of the housing.

The hair dye can be prepared outside the housing and then introduced into the housing for immediate application by opening the housing by removing or lifting the cover. In this case, the hair dye ready for application usually has a viscous to gel-like consistency. Optionally, the interior of the housing can also be provided with an elastic insert hag to hold the hair dye. The housing is subsequently closed again with the cover and held close to the scalp of the treated person in order to place a region of hair on the cover, so that the hair of the region of hair is distributed into the hair receptacles of they first and second sets and in this way is also divided into individual strands by the hair receptacles. For this purpose, it is provided that the hair receptacles each open towards the exterior of the housing for the insertion of regions of hair. By actuating the supply element, hair dye is fed from the interior of the housing to the dispensing openings of the hair receptacles of the first set, where it leaves the interior of the housing and is picked up by the relevant, channel-like hair receptacle, where it washes around the strand inserted in the relevant hair receptacle in the region of the dispensing opening. The hair receptacles of the second set and the strands received therein, on the other hand, remain free from hair dye. The hair receptacles of the first set and of the second set are each of channel-like design and run parallel to one another on the upper side of the cover, wherein the channel-like hair receptacles extend in a transverse direction of the cover and form a sequence of a plurality of hair receptacles in the longitudinal direction of the cover, wherein a hair receptacle of the first set is followed in each case by a hair receptacle of the second set.

The housing is subsequently slowly removed from the scalp of the treated person with the aid of the handle, wherein, on the one hand, the strands are formed by dividing the treated region of hair among the individual hair receptacles, and, on the other hand, the strands inserted in the hair receptacles of the first set are pulled through the hair dye and thus dyed. This movement can be assisted by a slight twisting of the housing. In this case, the device enables easier application while maintaining the same quality and width of the strands, since laborious shaping of the strands and brushing them with hair dye can be omitted. The process of applying the hair dye can also be carried out more quickly, since by placing the section of hair on the hair receptacles, the strands are also simultaneously shaped and dyed strand by strand, wherein dripping of the hair dye or the like can be avoided to the greatest possible extent, so that clean working is also made possible.

The supply element is preferably designed as a feed plate arranged inside the housing and movable in the direction of the dispensing openings of the hair receptacles of the first set. This movement exerts pressure on the hair dye accommodated inside the housing, causing the hair dye to emerge from the housing via the dispensing openings. For this purpose, it may also be provided that the handle has a stationary upper part and a lower part pivotable on the upper part, wherein the lower part is pivotably connected to the supply element designed as a feed plate. The operation can thus be performed with a single hand, namely with that hand which also holds the handle. By closing the fist in the case of a pincer-like design of the upper and lower parts, or by operating a trigger-like operating element, the pivotable lower part can be actuated, whereby the feed plate is moved in the direction of the dispensing openings. In order to be able to make the housing as cuboidal as possible, it is also proposed that the supply element designed as a feed plate is guided via a parallelogram guide in the course of the pivoting movement of the lower part. This parallelogram guide enables a translational movement of the feed plate with a constant angular position and is implemented, for example, with the aid of a parallelogram joint.

According to a preferred embodiment, it is further proposed that the housing is cuboid-shaped, with a front side surface of the housing being concave. The concave design of a side surface allows the housing to be brought closer to the scalp, which by its nature is not flat but curved.

In such a cuboid design of the housing, the dispensing openings are preferably arranged along a side edge of the cover extending in the longitudinal direction of the housing. In this way, the hair dye can be applied very close to the scalp.

In order to improve color application on the one hand and to enable excess hair dye to be wiped off on the other, it is also proposed that a brush lever having brushes is provided which can be pivoted about a lever pivot axis extending transversely to the longitudinal direction of the housing from a position close to the cover, in which the brush lever at least partially covers the hair receptacles relative to the housing exterior and the brushes project into the hair receptacles, into a position remote from the cover, in which the brush lever exposes the hair receptacles relative to the housing exterior. In particular, it is advantageous if the brush lever can be moved in its position close to the cover in the direction of a sliding axis from an active position, in which the brushes protect into the dispensing area of the dispensing openings, to an inactive position, in which the brushes are spaced apart from the dispensing area of the dispensing openings. The brush lever is in its position remote from the cover during insertion of the region of hair into the hair receptacles so as not to interfere with the insertion of the region of hair. After insertion of the region of hair, the brush lever can be pivoted into its position close to the cover, in which the brush lever at least partially covers the hair receptacles with respect to the housing exterior and the brushes project into the hair receptacles. Preferably, a first return spring is tensioned in the process. Subsequently, the brush lever can be moved in the direction of the sliding axis into its active position, in which the brushes project into the dispensing area of the dispensing openings. Preferably, a second return spring is tensioned in this case. The pivoting movement and the sliding movement can preferably be carried out with the thumb of a single hand, namely with the hand that also holds the handle. Preferably, the brush lever can be locked in its active position to allow the operator to continue working without having to manually fix the brush lever in its active position. After the hair dye has been applied and the device has been "pulled off" along the treated region of hair, the locking mechanism can be released, wherein the second return spring moves the brush lever into its inactive position, and the brush lever can subsequently be pivoted up into its position away from the cover, supported by the first return spring.

For this purpose, it is also advantageous if the slide axis is also the lever pivot axis and extends at an acute angle to the side surface of the housing facing the handle. The acute angle will open in the direction of a front side surface of the housing. In this way, the brush lever is also moved away from the front side surface at the same time as it is pivoted up, preventing unintentional contact of the head hair with the color-bearing brushes of the brush lever.

It is further proposed that the handle has a longitudinal axis that is angled with respect to the longitudinal direction of the housing. As has already been mentioned, it is advantageous to bring the housing as close as possible to the scalp. This process is facilitated by an angled arrangement of the handle.

Figure 2:
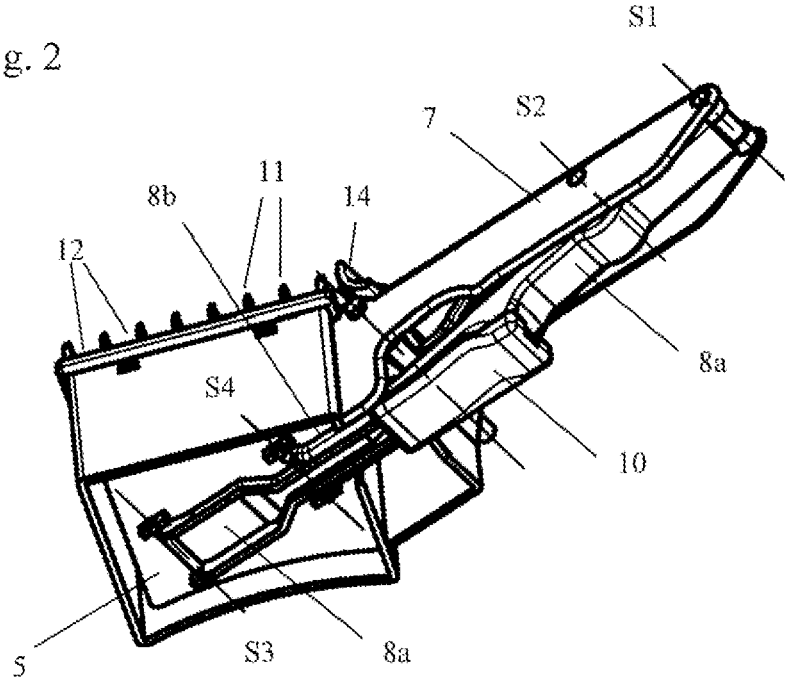
Figure 3:
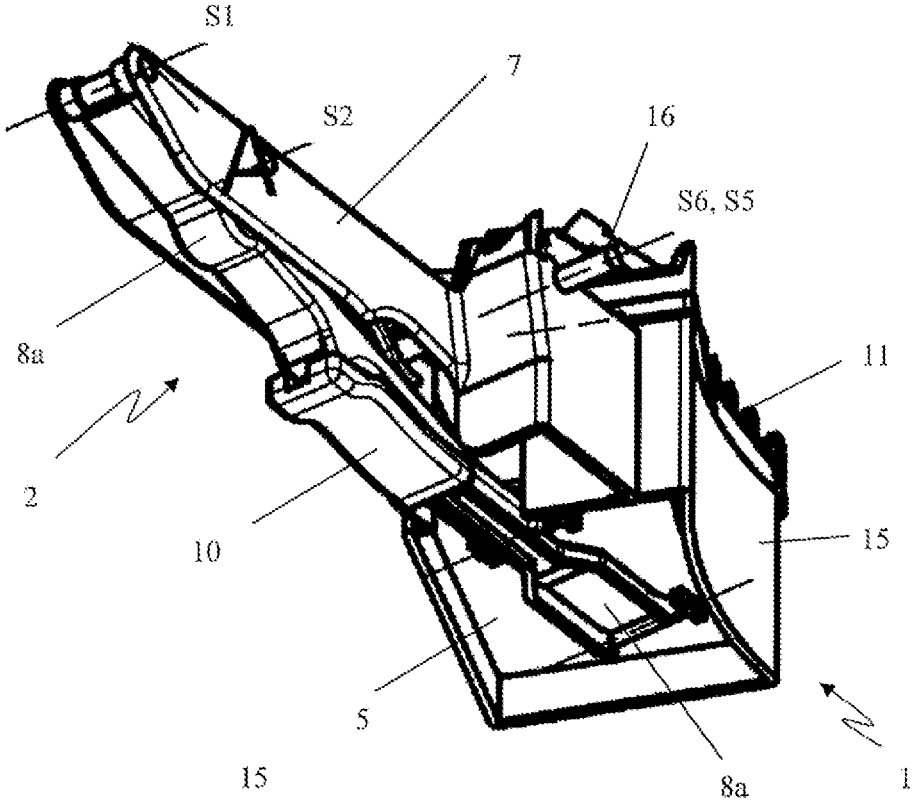
Figure 4:
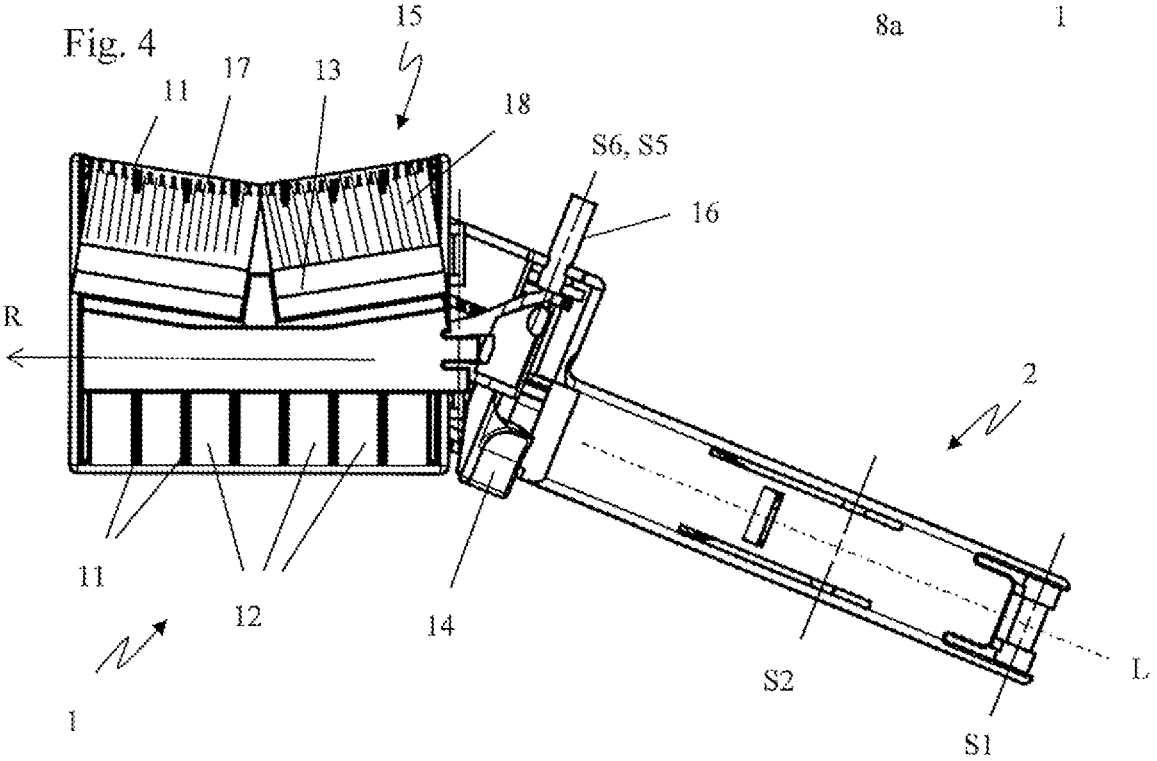
Figure 5B:
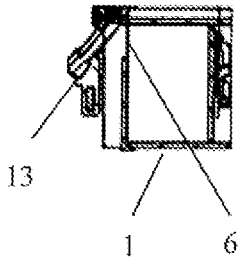
Figure 5A:
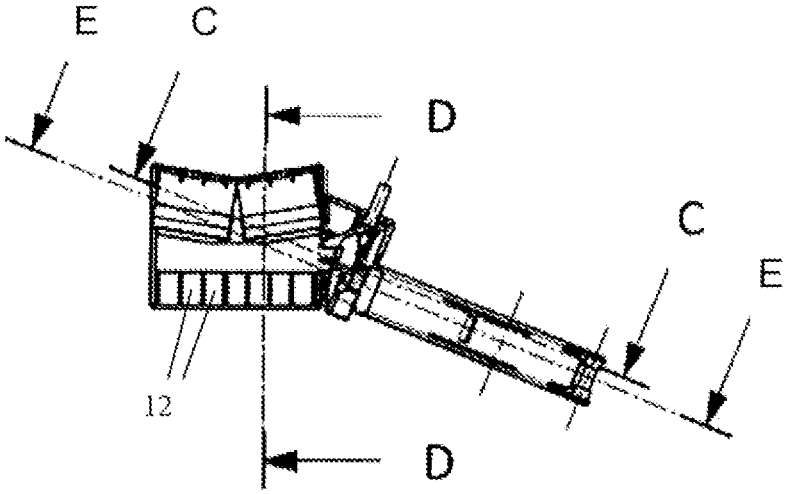
Figure 5C:
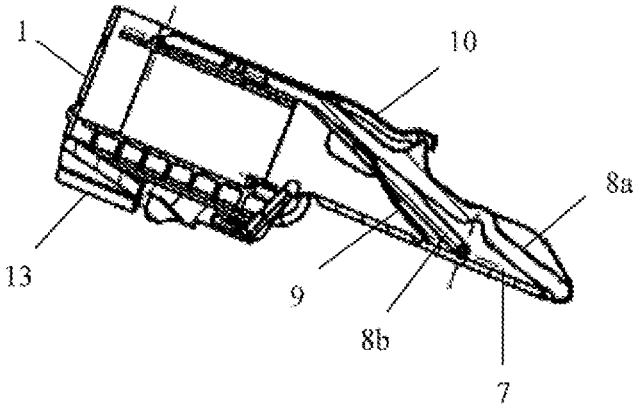
Figure 5D:
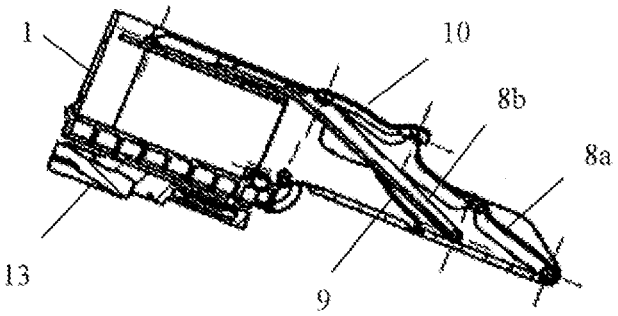
Figure 6:
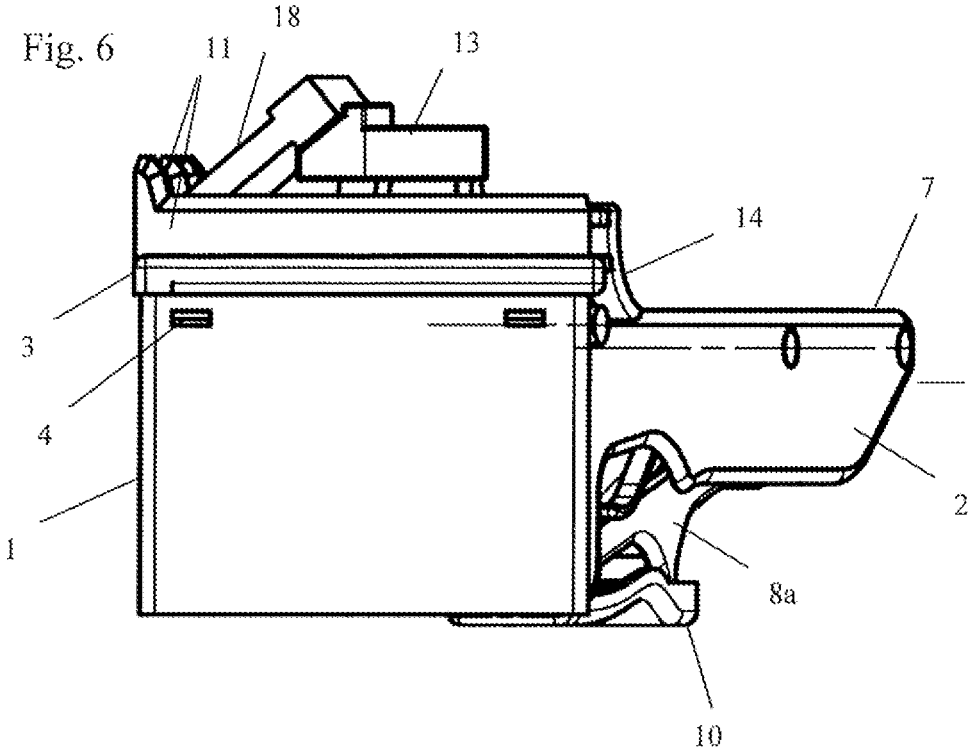
Figure 7:
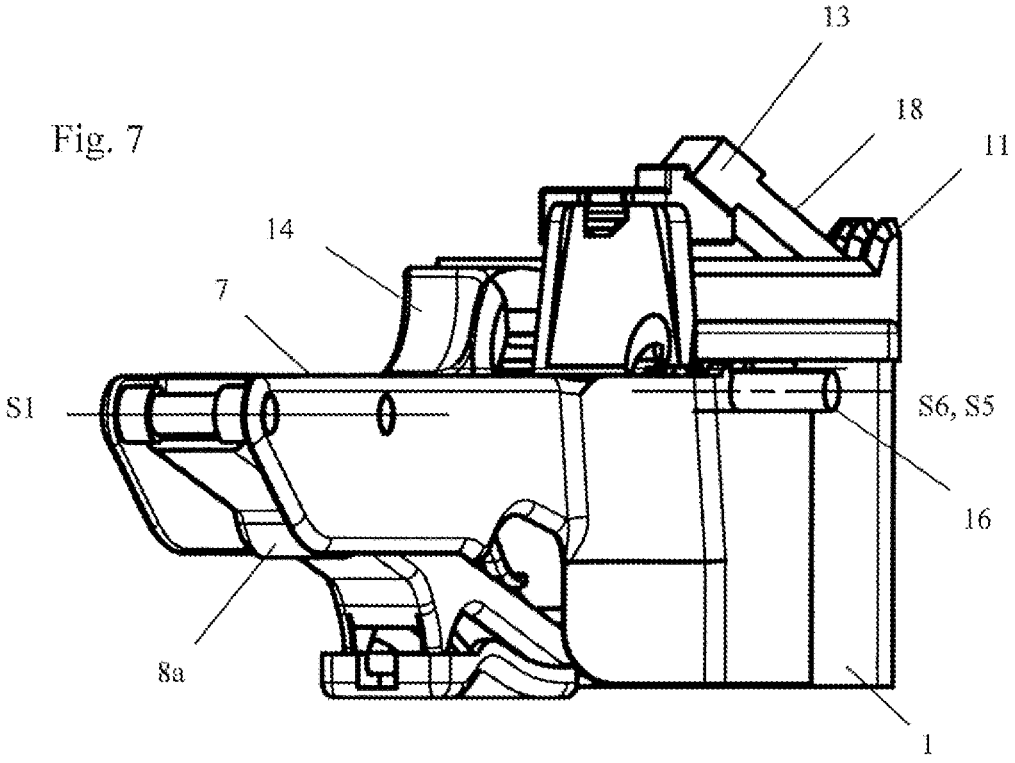
Figure 8:
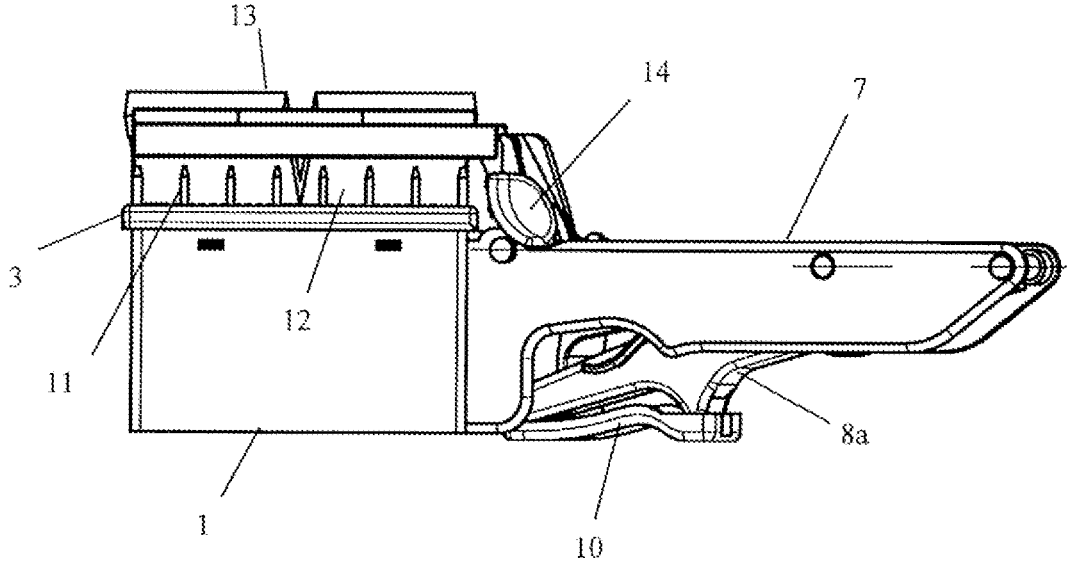
Figure 9:
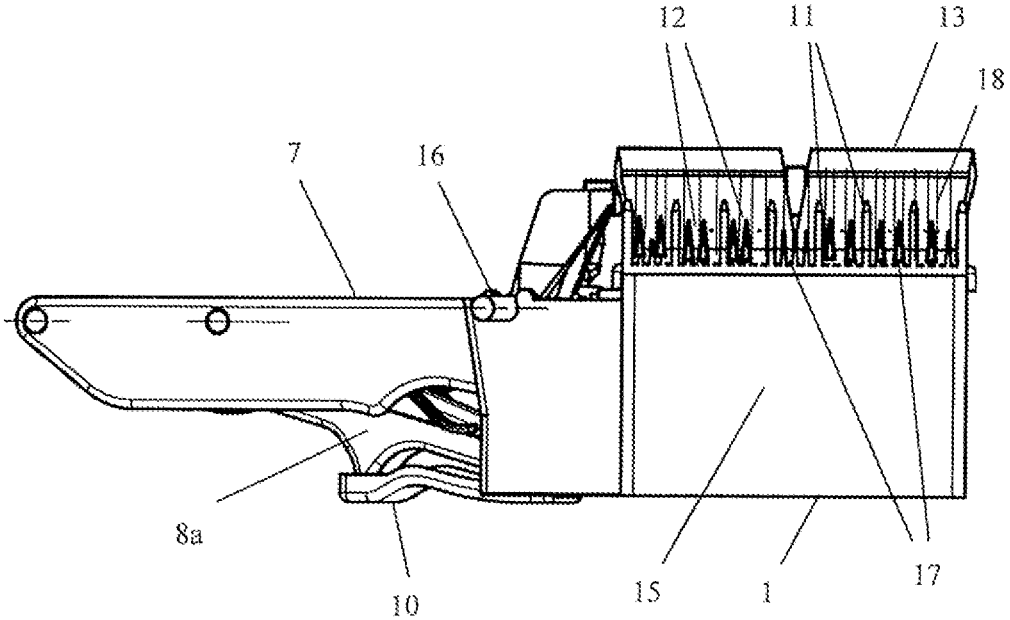

The invention is explained in more detail below by means of exemplary embodiments with the aid of the accompanying figures, wherein:

FIG. 1 shows a rear view of a perspective representation of an embodiment of the invention, as viewed from an oblique top view, FIG. 2 shows a rear view of a perspective representation of an embodiment of the invention according to FIG. 1, as viewed from diagonally below, FIG. 3 shows a front view of a perspective representation of an embodiment of the invention according to FIG. 1, as viewed from diagonally below, FIG. 4 shows a representation of an embodiment of the invention according to FIG. 1 as seen from above, FIG. 5*a* shows a representation of an embodiment of the invention according to FIG. 1 as seen from above with the sectional planes C-C, D-D and E-E drawn in, FIG. 5*b* shows a section for the embodiment of the invention according to FIG. 5*a* along the sectional plane D-D, FIG. 5*c* shows a section for the embodiment of the invention according to FIG. 5*a* along the sectional plane C-C, FIG. 5*d* shows a section for the embodiment of the invention according to FIG. 5*a* along the sectional plane E-E, FIG. 6 shows a side view of the embodiment of the invention according to FIG. 1 as seen from the side facing away from the handle, FIG. 7 shows a side view of the embodiment of the invention according to FIG. 1 as seen from the side facing the handle, FIG. 8 shows a rear view of the embodiment of the invention according to FIG. 1, and the FIG. 9 shows a front view of they embodiment of the invention according to FIG. 1.

Reference is first made to FIGS. 1 to 4, which show an embodiment of the invention in different views. The device has a housing for receiving a hair dye, wherein the housing 1 is substantially cuboidal in shape. A handle 2 is integrally formed on or attached to one of the side surfaces of the housing 1 with a longitudinal axis L, which is shown in FIG. 4. The respective side surface is also referred to hereinafter as the side surface of the housing 1 facing the handle 2. In the embodiment shown, the handle 2 is arranged on the housing 1 such that the longitudinal axis L of the handle 2 is angled with respect to a longitudinal direction R of the housing 1, as can be seen in particular in FIG. 4. The handle 2 may further be provided with a handle sleeve which can be slid onto the handle 2 in order to be able to adapt the handle 2 in terms of its cross-section or its length in a more haptically pleasant manner to the hand of an operator.

A cover 3 is removably attached to an upper side of the housing 1, for which clip fasteners 4 are provided in the embodiment shown, in each of which a resilient tab of the cover 3 detachably snaps into a corresponding pocket of the housing 1. However, the cover 3 can also be pivotally attached to the housing 1 so that it can flip up and expose the interior of the housing. Immediately prior to applying the hair dye to the scalp hair of a person to be treated, the housing 1 can be opened by removing or flipping up the cover 3 to introduce a hair dye into the housing 1. The hair dye is generally formed from a composition of a t least two components which are mixed together immediately prior to application. This preparation will usually take place outside the housing 1, with the ready-prepared hair dye being filled into the housing 1. Afterwards, the housing 1 can be closed again by putting on or closing the cover 3.

As can be seen from FIGS. 2 and 3, a supply element 5 is provided, which in the exemplary embodiment shown is designed as a feed plate, which also forms the housing base of the housing and is arranged within the housing 1 so to be movable in the direction of the cover 3. During this movement, hair dye is conveyed in the direction of dispensing openings β so that the feed plate serves as a supply element 5, as will be explained in more detail. For this purpose, the handle 2 in the embodiment shown is designed in a pincer-like manner with a stationary upper part 7 and a lower part B pivotable on the upper part 7, wherein the lower part 8 is pivotably connected to the supply element 5. For further explanation of the movability of the supply element 5, reference is also made to FIG. 5. In order to enable a translational movement of the supply element 5 designed as a feed plate with a constant angular position within the housing 1, the feed plate is guided with the aid of a parallelogram guide, which in the present case is realized with the aid of a parallelogram joint. For this purpose, the lower part. 8 has a first parallelogram link 8*a* and a second parallelogram link 8*b*, which are fastened on the one hand to the upper part 7 of the handle 2 so as to be pivotable about the pivot axes S1 and S2, and on the other hand to the feed plate about the pivot axes S3 and S4, as can be seen in particular from FIG. 2 and FIG. 5*c*. A spring element 9 ensures the return of the supply element 5 to its lower position as shown in FIG. 5*c*. The operation can thus be performed with a single hand, namely with that hand which also holds the handle 2. By closing the fist, the pivotable lower part 8 can be actuated, whereby the supply element 5, designed as a feed plate, is moved in the direction of the dispensing openings 6 (FIG. 5*b*) with a constant angular position.

A parking piece 10 is further attached to the second parallelogram link 8*b*, which is intended to allow the device to be parked in an upright position when not in use.

On its upper side, the cover 3 has webs 11 extending perpendicularly to the longitudinal direction R, which form groove-like hair receptacles 12 between them. The webs 11 can also have different heights in the course of their longitudinal extension, as can be seen for example in FIG. 1. The groove-like hair receptacles 12 thereby form a sequence of hair receptacles 12 arranged next to one another in the longitudinal direction R of the housing 1, which each open towards the exterior of the housing for the insertion of regions of hair, wherein in a first set of the hair receptacles 12 the hair receptacles 12 are each connected to the interior of the housing via dispensing openings 6 for dispensing hair dye, and hair-dye-free hair receptacles 12 of a second set are arranged between the hair receptacles 12 of the first set, which hair receptacles 12 do not have these dispensing openings 6 and are thus closed with respect to the interior of the housing. In the embodiment shown, the dispensing openings 6 are arranged along a side edge of the cover 3 extending in the longitudinal direction R of the housing. That side surface of the housing 1 which extends along this side edge is subsequently referred to as the front side surface 15 and is of concave design, as can be seen for example in FIG. 3.

Above the cover 3, a brush lever 13 is provided, which can be seen clearly in FIG. 1, for example, which can be pivoted about a lever pivot axis S5 extending transversely to the longitudinal direction R of the housing 1 (see FIG. 4) from a position close to the cover, in which the brush lever 13 at least partially covers the hair receptacles 12 with respect to the exterior of the housing and the brushes 18 of the brush lever 13 project into the hair receptacles 12, into a position far from the cover, in which the brush lever 13 exposes the hair receptacles 12 with respect to the exterior of the housing. In addition, in the exemplary embodiment shown, the brush lever 13 is displaceable in its position close to the cover in the direction of a sliding axis S6 (see, for example, FIG. 1 or FIG. 4) from an active position, in which the brushes 18 project into the dispensing area of the dispensing openings 6, to an inactive position, in which the brushes 18 are spaced apart from the dispensing area of the dispensing openings 6. In the embodiment shown, the sliding axis S6 is also the lever pivot axis S5 and extends at an acute angle to the side surface of the housing 1 facing the handle 2, with the acute angle opening in the direction of the front side surface 15 of the housing 1, as can be seen in FIG. 4, for example. In this way, the brush lever 13 is also moved away from the front side surface 15 at the same time as it is pivoted up, preventing unintentional contact of the head hair with the color-bearing brushes 18 of the brush lever 13. The brushes 18 were indicated in FIG. 4 and FIG. 9.

FIG. 6 shows a side view of the embodiment of the invention according to FIG. 1 as seen from the side facing away from the handle. FIG. 7 shows a side view of the embodiment of the invention according to FIG. 1 as seen from the side facing towards the handle. FIG. 8 shows a rear view of the embodiment of the invention according to FIG. 1, and FIG. 9 shows a front view of the embodiment of the invention according to FIG. 1.

In the following, the operation of the device according to the invention will be described. In the initial position of the color application on a region of hair, the device is held with the front side surface 15 of the housing 1 as close as possible to the scalp of the person to be treated. The concave design of the front side surface 15 and the angled position of the handle 2 facilitate this positioning of the housing 1 close to the head.

In this initial position close to the head, a region of hair a so-called passé—is picked up and placed in the hair receptacles 12. During the insertion of the region of hair into the hair receptacles 12, the brush lever 13 is in its position away from the cover so as not to interfere with the insertion of the region of hair. When the region of hair is inserted into the cover 3, the individual strands are separated from each other by the webs 11 and distributed among the hair holders 12.

After the region of hair has been inserted, the brush lever 13 can be pivoted about the lever pivot axis S5 into its position close to the cover, in which the brush lever 13 at least partially covers the hair receptacles 12 relative to the outside of the housing and the brushes 18 project into the hair receptacles 12. A first return spring is tensioned in the process. Subsequently, the brush lever 13 can be moved in the direction of the sliding axis S6 into its active position, in which the brushes 18 project into the dispensing area of the dispensing openings 6. Here, the second return spring is tensioned, with an operating element 14 facilitating this displacement movement. The pivoting movement as well as the sliding movement can thereby preferably be carried cut with the thumb of a single hand, namely with that hand which also holds the handle 2. Preferably, the brush lever 13 can be locked in its active position to enable the operator to continue working without having to manually fix the brush lever 13 in its active position.

By actuating the lower part 8 of the handle 2 and the resulting pivoting of the feed plate 5 in the direction of the dispensing openings 6, hair dye is fed from the interior of the housing to the dispensing openings 6 of the hair receptacles 12 of the first set, where it leaves the interior of the housing and is picked up by the relevant, channel-like hair receptacle 12 of the first set, where it washes around the strand inserted in the relevant hair receptacle 12 in the region of the dispensing opening 6. The hair receptacles 12 of the second set, on the other hand, remain hair dye-free. The housing 1 is subsequently slowly removed from the scalp of the treated person with the aid of the handle 2, wherein, on the one hand, the strands are formed by dividing the treated region of hair among the hair receptacles 12, and, on the other hand, the strands inserted in the hair receptacles 12 of the first set are pulled through the hair dye and thus dyed with the assistance of the brushes 18. This movement can be accompanied by a slight twisting of the housing 1. The brushes 18 of the brush lever 13 thereby improve the color application to the region of hair to be colored on the one hand and enable excess hair dye to be wiped off on the other hand. In order to improve the wiping off of excess hair dye and to prevent dripping of hair dye, color wipers 17 can also be provided, which are designed as knobs or pins and are arranged along the side edge of the cover 3 extending in the longitudinal direction R of the housing 1 (see FIG. 9).

After the hair dye has been applied and the device has been "pulled off" along the treated section of hair, the locking mechanism can be released by actuating a pin 16, wherein the second return spring moves the brush lever 13 along the sliding axis S6 into its inactive position, and the brush lever 13 can subsequently be pivoted upwards, supported by the first return spring, about the lever pivot axis S5 into its position remote from the cover. The device is now ready for the application of hair dye to a further section of hair.

It is also conceivable to design the cover 3 in an interchangeable manner and to make the cover 3 different, for example with different widths of the hair receptacles 12, or also with a variable clear cross-section of the hair receptacles along their longitudinal extension, in order to realize different effects in the colored hair.

The device facilitates the shaping of strands and the application of hair dye with consistent quality, and enables faster and cleaner work. In particular, the tedious shaping of strands and brushing them with hair dye can be omitted. The process of applying the hair dye can also be carried out more quickly, and dripping of the hair dye or the like can be largely avoided, so that clean work is made possible.

The invention claimed is:

1. A device for applying a free-flowing hair dye to regions of hair, wherein a housing having a handle is provided with a housing interior for receiving the free-flowing hair dye, and the housing is provided with a cover which has a row of hair receptacles disposed thereon and which are arranged next to one another in a longitudinal direction of the housing and extend wherein each hair receptacle defines a channel channel-like manner extending in a transverse direction transverse to the longitudinal direction of the housing, which where each channel opens toward the housing exterior for insertion of the regions of hair, wherein the row of hair receptacles comprise a first set of the hair receptacles the hair receptacles which are each connected to the housing interior via dispensing openings for dispensing hair dye, and wherein the row of hair receptacles comprise a second set of the hair receptacles that are hair-dye-free hair receptacles of a second set and are arranged between the hair receptacles of the first set, and a supply element is arranged in the housing interior for supplying hair dye from the housing interior to the dispensing openings of the first set of hair receptacles of the first set; and wherein a brush lever having brushes is provided, the brush lever being is configured to pivot about a lever pivot axis extending transversely to the longitudinal direction of the housing from a position close to the cover, in which the brush lever at least partially covers the hair receptacles with respect to the housing exterior and the brushes project into the hair receptacles, to a position remote from the cover, in which the brush lever exposes the hair receptacles with respect to the exterior of the housing.

2. The device according to claim 1, wherein the supply element is designed as a feed plate arranged within the housing interior and the feed plate is configured to be movable move in a direction of the dispensing openings of the hair receptacles of the first set.

3. The device according to claim 2, wherein the handle has a stationary upper part and a lower part pivotable on the stationary upper part, wherein the lower part is pivotably connected to the supply element designed as a feed plate.

4. The device according to claim 3, wherein the supply element, which is designed as a feed plate is guided via a parallelogram guide in the course of a pivoting movement of the lower part.

5. The device according to claim 1, wherein the housing is cuboidal design, wherein a front side surface of the housing is of concave design.

6. The device according to claim 1, wherein the housing is cuboidal design, and the dispensing openings are arranged along a side edge of the cover extending in the longitudinal direction of the housing.

7. The device according to claim 1, wherein the brush lever is displaceable in its position close to the cover in the direction of a sliding axis from an active position, in which the brushes project into the dispensing area of the dispensing openings, into an inactive position, in which the brushes are spaced apart from the dispensing area of the dispensing openings.

8. The device according to claim 7, wherein the sliding axis is at the same time coincident with the lever pivot axis and extends at an acute angle to the side surface of the housing facing the handle.

* * * * *